United States Patent [19]

Puttemanns et al.

[11] Patent Number: 4,521,836

[45] Date of Patent: Jun. 4, 1985

[54] ELEVATED AIRPORT RUNWAY, TAXIWAY, OR THRESHOLD EDGE LIGHT WITH SEALED GLASS DOME

[76] Inventors: Louis Puttemanns, 24 Saint Paulus La., Tervuren 1981; Jean J. R. Plas, 2 Clos des Trotteurs, Wezembeek 1970, both of Belgium

[21] Appl. No.: 624,152

[22] Filed: Jun. 25, 1984

[51] Int. Cl.[3] ..... F21S 1/14

[52] U.S. Cl. ..... 362/145; 362/62; 362/368; 362/431; 362/267; 362/374; 362/308; 362/375; 362/337; 362/421

[58] Field of Search ..... 362/62, 145, 152, 267, 362/421, 431, 308, 337, 368, 374, 375

[56] References Cited

U.S. PATENT DOCUMENTS

| | | | |
|---|---|---|---|
| 2,359,151 | 9/1944 | Pennow | 362/267 |
| 2,773,172 | 12/1956 | Pennow | 362/431 X |
| 2,934,633 | 4/1960 | Cummings | 362/267 |
| 3,501,627 | 3/1970 | Macemon | 362/421 |
| 4,104,711 | 8/1978 | Carter | 362/431 X |
| 4,180,850 | 12/1979 | Bivens | 362/145 X |
| 4,393,440 | 7/1983 | Yperman | 362/145 X |

*Primary Examiner*—Peter A. Nelson

[57] ABSTRACT

An elevated airport runway, taxiway, or threshold edge light with a glass dome that is so positioned with respect to the light source so as to correct for variations in thickness of the base of the glass dome as the result of the glass-making process. The glass dome is sealed into an overhanging cover which preserves the integrity of the interior of the light against adverse weather conditions and the support base on which the cover is positioned is provided with a ball joint so as to permit quick and easy elevation and azimuth positioning of the base in the field. The base is also provided with a vertical support for a snow flag.

7 Claims, 3 Drawing Figures

ELEVATED AIRPORT RUNWAY, TAXIWAY, OR THRESHOLD EDGE LIGHT WITH SEALED GLASS DOME

BACKGROUND OF THE INVENTION

Tne Federal Aviation Administration has certain minimum standards with respect to the light shape and intensity provided by elevated airport runway, taxiway, and threshold edge lights. For example, for blue taxiway lights, FAA Advisory Circular AC 150/5345-48 in FIG. 6 provides for an isocandela curve for minimum output in blue light for the L-861-T Taxiway light.

Similar standards are provided by the Federal Aviation Administration for other colored and white lights. Comparable standards exist in other countries dictated by the appropriate agency having jurisdiction in that particular country.

In order to meet these standards, the glass dome which surrounds the light source is formed with a varying internal shape which constitutes a prismatic lens so that the light may conform to these standards. It is essential that the relative relationship between the light source, which is an incandescent electric bulb, and the prismatic lens be maintained within very close tolerances. Variations of as little as 0.025 inches can result in the spectral shape not conforming to the minimum FAA or other country's requirements.

Additionally, the elevated airport runway, taxiway, and threshold edge lights must be capable of being positioned absolutely level even though the vertical post on which they are supported may not be perfectly vertical as the result of installation procedures. Even though there are slight variations in the elevation of the terrain on which the lights are positioned, it is essential that the lights all be in the same horizontal plane.

Furthermore, in climates where snow must be removed from the runway with snowplows, it is essential that the lights be identified with flags attached thereto which will extend above the snow so that the snowplow does not come in contact with the lights.

The present state of the art involves two types of elevated airport runway, taxiway, or threshold edge lights and are referred to as the twist lock tab- and the metal band- or metal clamp-type.

In the twist lock tab-type light the glass dome is provided with a segmented lip at the base thereof extending outwardly at right angles to the axis of the light in the form of three separate tabs. These tabs fit under comparable lips in the base of the light and the glass dome is secured by twisting it in a bayonet-type lock. The glass dome also abuts against an O-ring positioned in a groove in the upper periphery of the base as a seal against water, ice, and snow.

The disadvantages of this type of light are as follows: In the glass molding process, the thickness of the tabs at the base of the glass dome can vary as much as 1/16th of an inch in thickness. Thus when the glass dome is positioned in its bayonet joint the relative position of the prism in the glass dome with respect to the light source can vary to such an extent that the spectral shape of the light is altered so as not to meet minimum agency standards. Furthermore, the rotating motion of the glass against metal in seating the glass dome, either during initial installation or when replacing the light source, inherently has the possibility of chipping or cracking the dome and this is accentuated if ice or snow is present.

This type of light also, because of its construction, tends to channel any moisture into the area where the glass dome attaches to the metal base so that if there is any possible entrance point for moisture, the design encourages moisture to enter at such point.

The elevated airport runway, taxiway, and threshold edge lights of this twist lock tab-type also are leveled by means of four (4) separate leveling screws which require multiple adjustments and consequent excessive labor charges to achieve a level position of the light. Furthermore, the flag holder is so shallow that when the flag shaft is inserted therein, unless the shaft is wired or otherwise tied to the supporting conduit beneath the light, the flag will not remain in an upright position.

The metal band- or metal clamp-type elevated airport runway, taxiway, or threshold edge light has all of the disadvantageous features described above with respect to the twist lock tab-type light.

In the metal band- or metal clamp-type light, the glass dome is positioned on the metal base by means of a circumferentially extending metal clamp or band which engages an outwardly extending lip on the metal base and a corresponding outwardly extending lip on the base of the glass dome. This type of junction inherently permits moisture to enter the interior of the glass dome and also variations in thickness of the glass lip which are normal in the glass manufacturing process will permit unacceptable positioning differences between the prism portion of the glass dome and the light source so as to cause the spectral shape of the light not to meet minimum standards. This type of light also has the same leveling and flag-holding disadvantages described above with respect to the twist lock tab-type light.

SUMMARY OF THE INVENTION

The present invention overcomes all of the above-described disadvantages of the prior art by providing a glass dome which is sealed into a cover with a polymeric resin, the cover being so constructed that it overhangs the base of the light, thus providing an absolute seal against moisture or water entering the interior of the light. This construction also permits the glass dome to be positioned accurately within the cover in the resin support during the manufacturing process so that variations in thickness of the base of the glass dome or the size of the glass dome may be compensated for by its positioning in the resin, thus insuring that the prism portion of the glass dome is precisely aligned with respect to the light source when the cover supporting the glass dome is attached to the base of the light, either during initial installation or when replacing the light source.

This invention is also provided with a ball joint in the base of the light where it is attached to the upstanding conduit so as to facilitate elevation and azimuth positioning of the light base which may then be secured by three (3) screws. Furthermore, since the edge of the cover extends downwardly over the light base, there is sufficient vertical space on the light base so as to provide a guide for exact positioning of the cover on the base which guide also functions as a flag holder having sufficient depth to hold the flagpole for snow removal purposes in a vertical position without the necessity of attaching the base of the flagpole to the conduit by wire or other means.

It is therefore an object of this invention to provide an elevated airport runway, taxiway, or threshold edge light with a glass dome which is effectively sealed against rain, snow, sleet, dust, or other unfavorable weather conditions.

It is a further object of this invention to provide such a light which mechanically prevents such weather elements from otherwise entering the interior of the light dome.

It is a still further object of this invention to provide such a light whereby the glass dome is always positioned precisely with respect to the light source regardless of variations in the shape of the glass dome as a result of the manufacturing process.

It is a still further object of this invention to provide such a light wherein the elevation and azimuth positioning of the light may be accomplished quickly and easily in the field.

It is a still further object of this invention to provide such a light in which the cover may easily, rapidly and safely be removed from the base in order to replace the light source and in which the cover may be replaced as easily, rapidly, and safely.

It is a still further object of this invention to provide such a light that will support a snow flag in a vertical position.

These, together with other objectives and advantages of the invention, should become apparent in the details of construction and operation, as more fully described herein and claimed, reference being had to the accompanying drawings forming a part hereof wherein like numerals refer to like parts throughout.

DETAILED DESCRIPTION OF THE DRAWINGS

Figure 1:
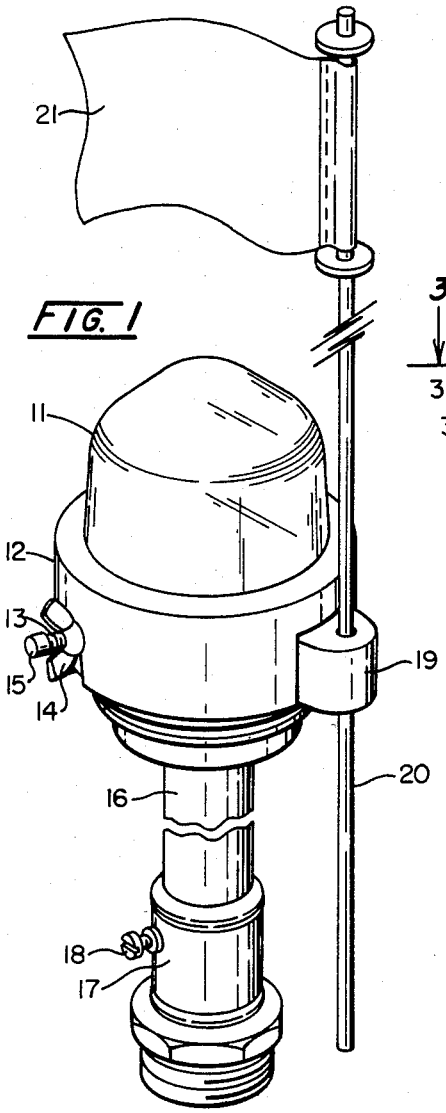
FIG. 1 is a perspective view of the elevated airport runway, taxiway, or threshold edge light of the instant invention.

Referring now more particularly to FIG. 1, the glass light dome is shown at 11 molded into and sealed in cover 12 which is made from a resin which is preferably polyurethane. The cover 12 is secured against movement. This may be done by a pair of threaded shafts 13—13 and wing nuts 14—14 provided with stops 15—15, or by an equivalent mechanism. The conventional electrical conduit 16 is shown positioned in a conventional vertical support 17 and the conduit 16 is held against movement by means of the screw 18. The member 19 is a part of the base which functions to align the cover and also functions as a flag holder adapted to hold the flagpole 20 of the snow flag 21.

Figure 2:
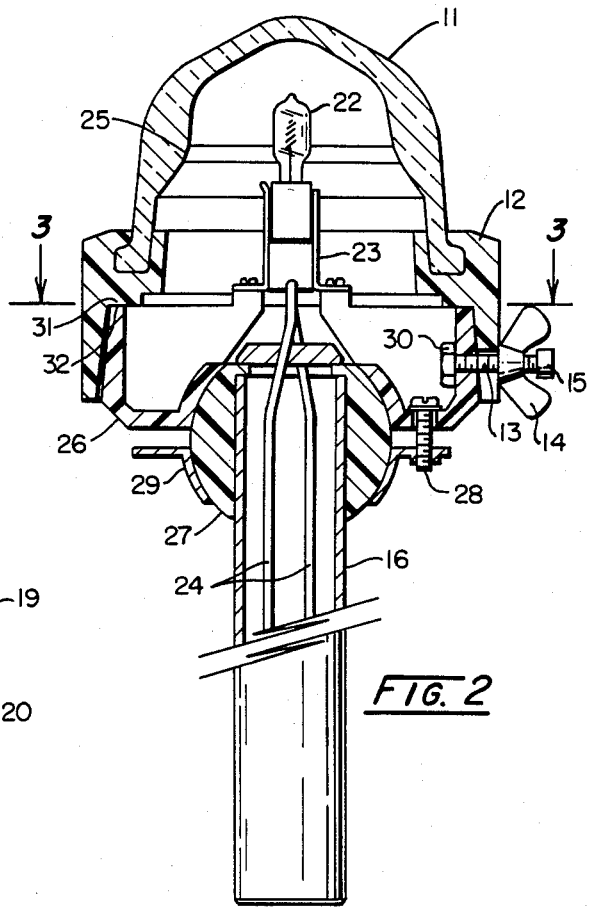
FIG. 2 is a side elevation, sectional view of the invention on the plane 2—2 of FIG. 3.

Referring now more particularly to FIG. 2, it will be seen that the incandescent light bulb 22 is positioned in a socket 23 connected in the usual manner to electrical leads 24—24. The light bulb 22 is precisely positioned with respect to the prism portion 25 of the glass dome 11. It will be noted that the interior of the base 26, which supports the cover 12, is protected from ingress of snow, rain, dust, etc. by means of the overhanging portion of the cover 12 coupled with the fact that the glass dome 11 is sealed in the cover 12.

Figure 3:
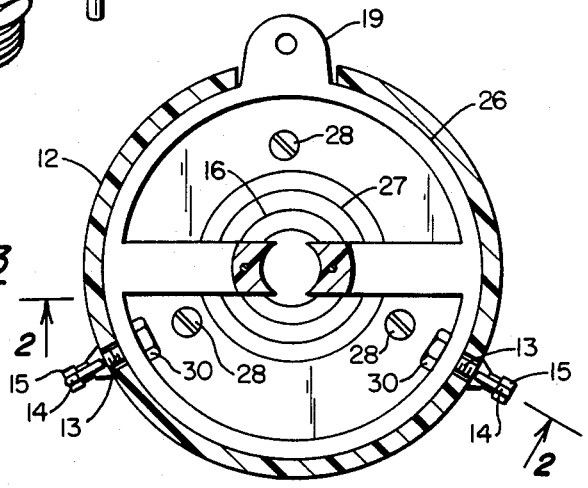
FIG. 3 is a plan, sectional view of the instant invention on the section line 3—3 of FIG. 2.

The ball joint 27 surrounds the upper end of the electrical conduit 16 and is made of a polyester material which also functions to act as a seal against moisture and dust. The base 26 is held in position on the ball joint by means of screws 28—28 of which there are three equispaced around the base 26 and threaded into member 29. It will be noted that threaded shafts 13—13 are threaded into base 26 and held in position by nuts 30—30. This may be seen more advantageously in FIG. 3 which also shows the positioning of screws 28—28.

The cover 12 and the base 26 are cast and the cover is preferably made from a polymeric resin such as polyurethane, while the base 26 is preferably made from a polyester resin.

In the manufacture of the instant invention, the glass dome 11 is positioned in the cover 12, for instance in a jig, so that the inner base portion 31 of cover 12 which will rest on the upper portion 32 of base 26 (see FIG. 2) will always be the same distance from the prism portion 25 of the glass dome 11 thus insuring that the glass dome 11 will always be properly positioned with respect to the light source 22.

In installing this light in the field, the proper length of conduit 16 is chosen in order to position the lights in the same horizontal plane and the conduit 16 is secured in the holder 17 by means of screw 18. By loosening screws 28—28, the elevation and azimuth of the base 26 may be adjusted quickly and easily by virtue of the 360° of freedom in the horizontal plane provided by the ball joint 27 and then the screws 28—28 are tightened to hold the base 26 in that position and to seal the underside of the base from the entrance of moisture and dust. In installing the cover 12 on the base 26, the member 19 provides positive position for the cover 12 with respect to the base 26 and the cover 12 is merely pushed down tightly on top of the base 26 and the wing nuts 14—14 are tightened and the installation is complete. Likewise, in removing the cover 12 and glass dome 11 in order to change the bulb 22, it is a simple matter to loosen the wing nuts 14—14 and lift the cover 12 vertically upward. Snow and ice cannot complicate this operation. In the event that it is necessary to use a snow flag, the shaft 20 is merely inserted in the hole in the member 19 and thus is held in a vertical rigid position.

While this invention has been described in its preferred embodiment, it is appreciated that variations thereon may be made without departing from the scope and spirit of the invention.

What is claimed is:

1. An elevated airport runway, taxiway, or threshold light comprising a substantially hollow base having a bottom wall, a ball joint centrally positioned in the bottom wall of said base and adapted to receive an upstanding conduit, said ball joint comprising adjustable securing means for fixedly positioning said base and said ball joint onto said upstanding conduit, means supported centrally on said base adapted to receive a light source, and a cover comprising a lower annular portion and a hollow glass dome including a prism portion sealed in said lower annular portion, said lower annular portion having an inner base portion resting on the upper portion of said hollow base, whereby the apex of said hollow glass dome is positioned a predetermined distance from said inner base portion and said bottom wall of said base, so that the prism portion is in proper registration with respect to said light source.

2. The light of claim 1 wherein said lower annular portion of said cover is provided with a downwardly extending peripheral portion which substantially overhangs said hollow base.

3. The light of claim 1 wherein said adjustable securing means comprises a member positioned below and engaging said ball joint, said member being removably secured to the bottom wall of said base, whereby said ball joint is secured to said upstanding conduit as it is secured to the bottom wall of said base.

4. The light of claim 1 wherein said adjustable means for fixedly positioning said conduit with respect to said base comprises three (3) screws engaging holes in the bottom of said base and threadedly connected to a complementary member positioned below and engaging said ball joint.

5. The light of claim 1 wherein said base is molded from a polyester resin and said cover is molded from a polyurethane resin.

6. The light of claim 1 wherein said ball joint comprises a hollow, ball-shaped, compressible plastic material surrounding the upper portion of said conduit.

7. The light of claim 1 wherein said base is equipped with an outwardly extending portion adapted to receive a complementary hollow portion in said cover so as to position said cover on said base and wherein said outwardly extending portion contains a vertical hole therein adapted to receive the pole of a snow flag.

* * * * *